US005511614A

United States Patent [19]

Jennings

[11] Patent Number: 5,511,614

[45] Date of Patent: Apr. 30, 1996

[54] HYDRAULIC SYSTEM FOR SERVICING WATER PUMPS IN WELLS

[76] Inventor: Kenneth L. Jennings, Rte. 2, Box 83-4, Strafford, Mo. 65757

[21] Appl. No.: 370,651

[22] Filed: Jan. 10, 1995

[51] Int. Cl.[6] ..... E21B 19/16

[52] U.S. Cl. ..... 166/65.1; 166/72

[58] Field of Search ..... 166/68.5, 72, 377, 166/65.1

[56] References Cited

U.S. PATENT DOCUMENTS

| | | | |
|---|---|---|---|
| 3,809,162 | 5/1974 | Sydor | 166/377 |
| 3,980,143 | 9/1976 | Swartz et al. | 166/377 X |
| 4,422,508 | 12/1983 | Rutledge, Jr. et al. | 166/377 X |
| 4,890,671 | 1/1990 | Baxter | 166/377 X |

*Primary Examiner*—William P. Neuder
*Attorney, Agent, or Firm*—Leonard Tachner

[57] ABSTRACT

A novel improved pump pulling system for pulling a pump from a deep well casing and including all the pipe normally attached to the pump. Pulling of the pump is normally required for maintenance purposes or for replacement of the pump. Normally such pumps are electrical and therefore an attendant electrical cable is also pulled with the pump when it is necessary to remove the pump from the well casing. The present invention facilitates and simplifies such pump pulling operations by providing three significant features comprising: A novel pulling unit which is designed to attach to the interior surface of the threaded end of each pipe section as it is disconnected from the next; a holding plate which is designed to overly the casing and facilitate securing the sections of pipe while each top section is threadably disconnected from the remaining sections; and a wire reel which is designed to operate in synchronism with the hydraulic lift mechanism to automatically spool on the electrical cable as it is released from the pipe sections to which it is normally attached in a typical pump installation.

12 Claims, 8 Drawing Sheets

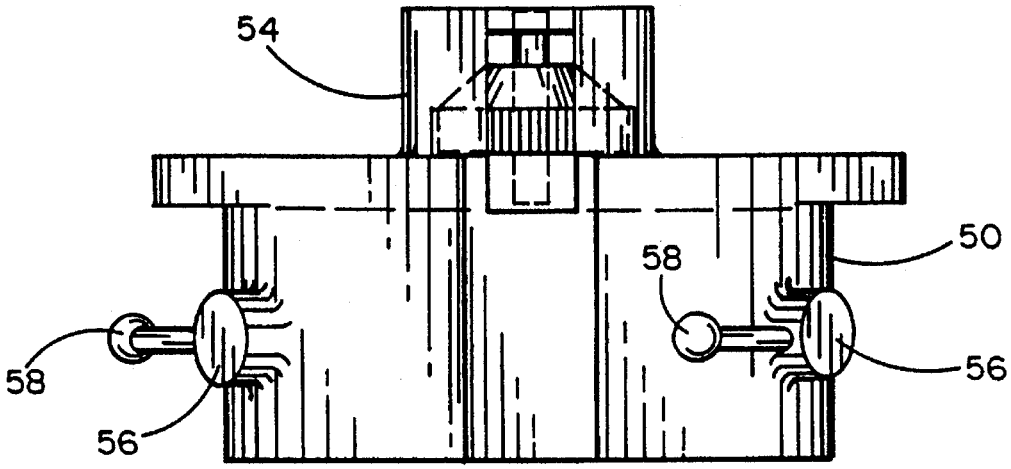
FIG. 10
FIG. 11
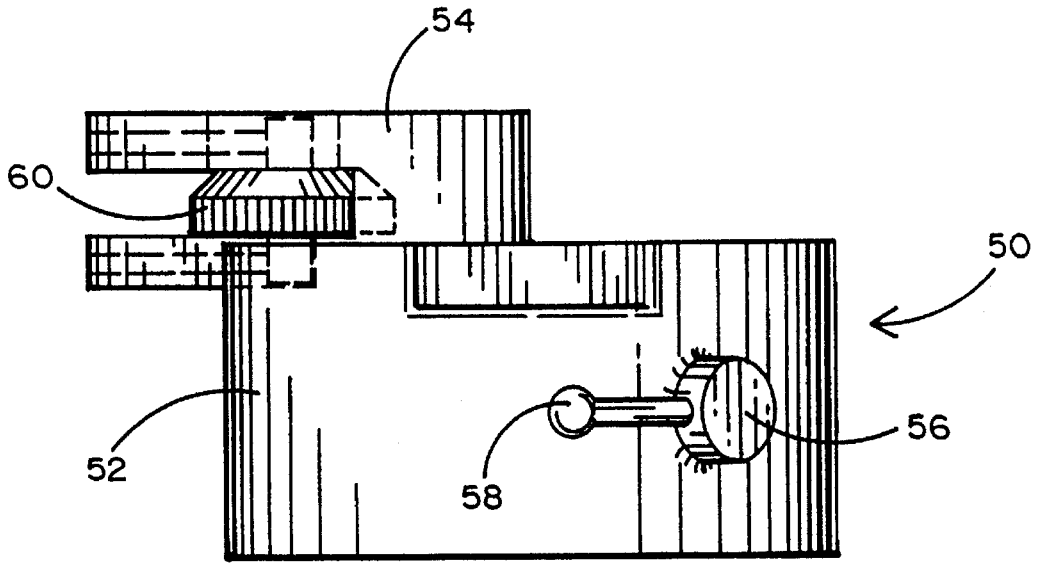

HYDRAULIC SYSTEM FOR SERVICING WATER PUMPS IN WELLS

BACKGROUND OF THE INVENTION

1. Field of the Invention

The present invention relates generally to apparatus for use in removing water pumps from deep wells for servicing thereof and more specifically to an improved hydraulic apparatus having a number of novel features designed to increase the convenience and decrease the difficulty associated with pulling an electric pump out of a deep well to service or replace the pump and reinstall it.

2. Prior Art

There are many areas in the United States where, unlike large cities which provide water from a central source to all its residents, each individual resident must provide his or her own source in the form of a water well. Typically, such water wells can be quite deep, depending upon the water table level in that area. In modern well water systems, the water is delivered to the surface through a long pipe usually made of polyvinyl chloride plastic by means of an electric pump and associated motor, both of which are positioned at the bottom of the well. Furthermore, the well is normally a very narrow shaft dug through the earth's surface to the depth required to reach the water table. The shaft is normally enclosed by a metal well casing to secure the shaft against collapse. The motorized pump is usually connected to an electrical source at the surface, thereby requiring the use of a long electrical cable which is normally affixed to the exterior surface of the pipe throughout the full length of the shaft.

Occasionally it becomes necessary to service the pump and motor or replace one or both such mechanisms and the length of the shaft, the weight of the pump motor and the pipe make it virtually impossible to manually pull the combination of pipe and pumps out of the well casing. Thus it becomes necessary to use a source of lifting power, typically provided by a hydraulic truck which provides a lifting force necessary to remove the pipe and the pump and then replace them and reinstall that combination after servicing is completed. Typically, the elongated plastic pipe that is attached to the pump at the bottom of the well casing and which brings the pumped water up to the surface, is provided in the form of a large plurality of pipe sections arranged in series and threadably interconnected one to the other in sequence. Typically, as the pipe and pump are withdrawn from the well casing, the threadable sections are disengaged from one another one at a time as the pipe is pulled to the surface and eventually the pump is pulled to the surface. As each pipe section is disengaged from the remaining pipe sections, the electrical cable connected to the exterior surface of the pipe must be disconnected so that eventually when the pump reaches the surface, one has a large plurality of pipe sections and a large length of electrical cable still connected to the pump to deal with.

Typical prior art relevant to the present invention includes other types of hydraulic systems which provide a power lifting capability for pulling the pipe and attached pump and motor to the surface of the well casing. However, the manner in which each pipe section is held in place while being unthreaded from the remaining sections and the manner in which the wire is handled as it is disconnected from each corresponding pipe section, leave much to be desired in terms of convenience and pipe and cable handling simplicity. Basically, service personnel required to pull the pipe and pump to service the pump are left to their own devices which can lead to damaged pipe sections, damaged pumps, a rat's nest of scrambled electrical cable and the potential for a costly or even tragic accident which can make the process of pulling a deep well pump and associated pipe a risky task at best.

There is therefore a continuing need for an improved hydraulic assembly for pulling a deep well pump and associated pipe and cable.

SUMMARY OF THE INVENTION

The present invention comprises an improved hydraulic pump-pulling system which has a number of significant advantageous features designed to overcome the disadvantages of the prior art and to provide service personnel with a far more convenient, simple and safe system for gaining access to deep well pumps for servicing or replacement thereof. A preferred embodiment of the invention disclosed herein illustrates three significant features which constitute improvements in the present invention. One such feature is a unique wire reel in the form of a hydraulically controlled spool which is preferably attached to the hydraulic vehicle at a location adjacent the lifting portion of the invention and which is adapted to rotate in response to the same hydraulic controls that lift the pipe and pump combination so that the attached cable can be wound simultaneously onto the spool as each section of pipe is withdrawn. A second feature of the present invention is a novel pulling unit which is designed to mate with the open top end of the pipe in a manner which does no harm to the pipe and yet which provides a secure connection thereto in a manner which permits each pipe section to be removed from the next and then readily released for pulling unit connection to the subsequent section of pipe. Still a third unique feature of the present invention comprises a holding plate which further facilitates withdrawal of the pipe and securing of each section as it is removed from the next, while using a cam wheel to temporarily secure the pipe while the operator unthreads or rethreads one section relative to another.

Thus it will be seen hereinafter that the present invention comprises a novel combination of unique features in a pump pulling system for use with a hydraulic system equipped vehicle and which renders obsolete the complicated, inconvenient and haphazard conventional method of pulling a pump out of a deep well casing for service or replacement thereof.

OBJECTS OF THE INVENTION

It is therefore a principal object of the present invention to provide an improved pump pulling system for use with a hydraulic equipped vehicle, the system comprising a hydraulic operated spool assembly, a pulling unit and a holding plate, the combination of which facilitates pulling a pipe and pump out of a deep well casing for service or replacement thereof.

It is another object of the present invention to provide a wire reel apparatus for use with a hydraulic system for automatically spooling or unspooling a long length of electrical cable to facilitate removing an electric pump and attendant pipe from a deep well system.

It is still an additional object of the present invention to provide a pipe pulling unit for use with a hydraulic equipped vehicle for pulling a length of pipe attached to a pump out of a well casing, the pulling unit facilitating temporary but secure attachment and detachment from sequential sections of pipe as each is pulled from the well casing.

It is still an additional object of the present invention to provide an improved pump pulling system having a holding plate for attachment to a well casing of a deep well system to facilitate removal of the pipe and pump therein for service and replacement thereof, the holding plate providing means for securing the length of pipe and pump as each section of pipe is detached or attached for removal or installation of the pipe and pump in the deep well casing.

BRIEF DESCRIPTION OF THE DRAWINGS

The aforementioned objects and advantages, as well as additional objects and advantages thereof, will be more fully understood hereinafter as a result of a detailed description of a preferred embodiment of the invention when taken in conjunction with the following drawings in which:

FIG. 10 is a front view of the holding plate of the present invention;

FIG. 11 is a side view of the holding plate of the present invention;

DETAILED DESCRIPTION OF A PREFERRED EMBODIMENT

Figure 1:
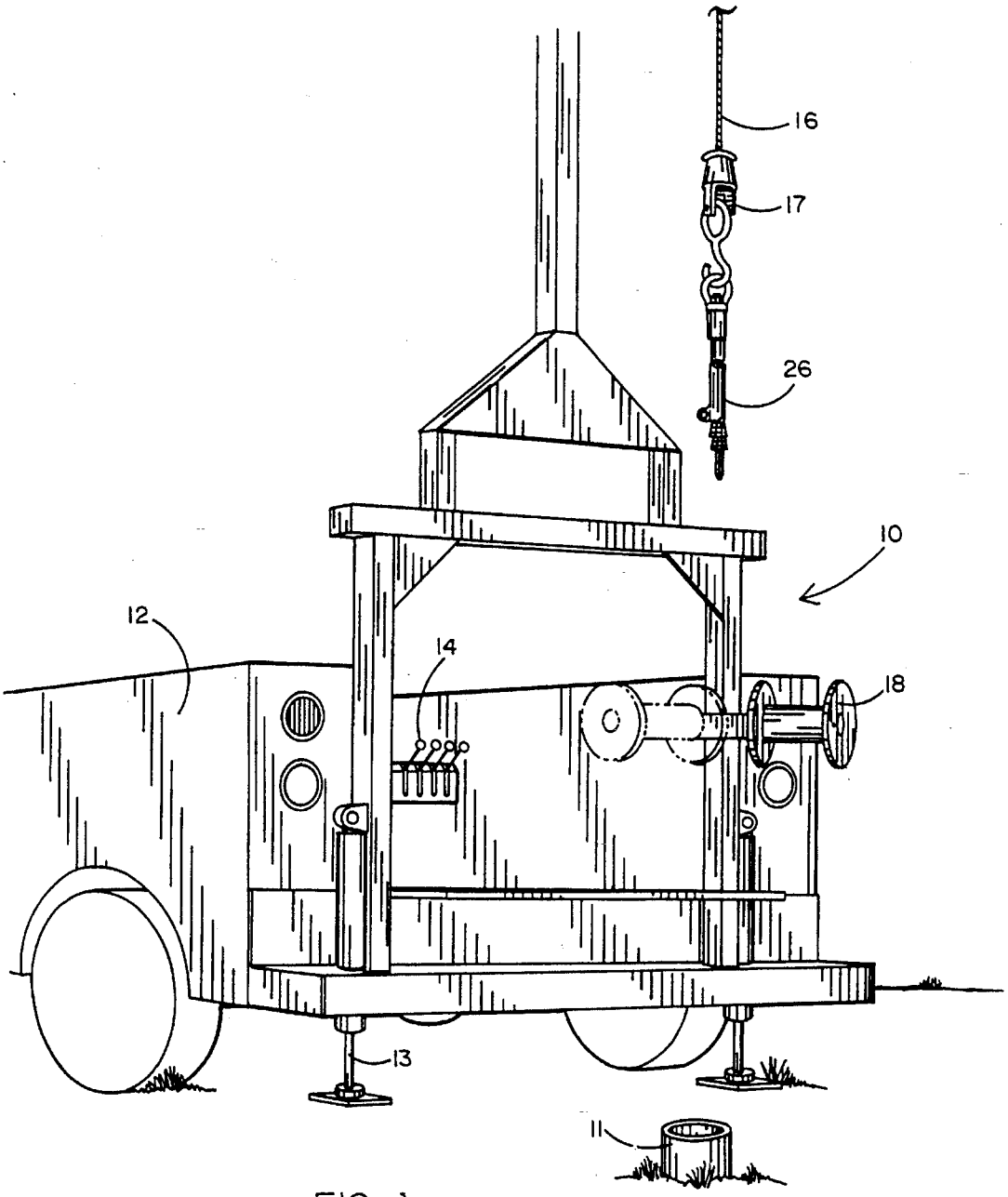
FIG. 1 is a three-dimensional view of a hydraulic-equipped vehicle typically used for pulling pumps from deep well casings, but shown equipped with the advantageous features of the present invention.

Referring to the accompanying figures, it will be seen that a pump pulling system 10 of the present invention comprises a hydraulic-equipped vehicle 12, preferably having a plurality of stabilizer stands 13 for positioning the vehicle adjacent a well casing 11. The vehicle is provided with a plurality of hydraulic controls 14 which, through conventional means, controls a hydraulic lift which raises and lowers a pulling cable 16 to which there is attached a rotatable yoke 17 and a pulling unit 26, the details of which will be more fully explained hereinafter. The hydraulic-equipped vehicle 12 also provides a wire reel 18, the purpose and operation of which will be more fully explained hereinafter.

Figure 2:
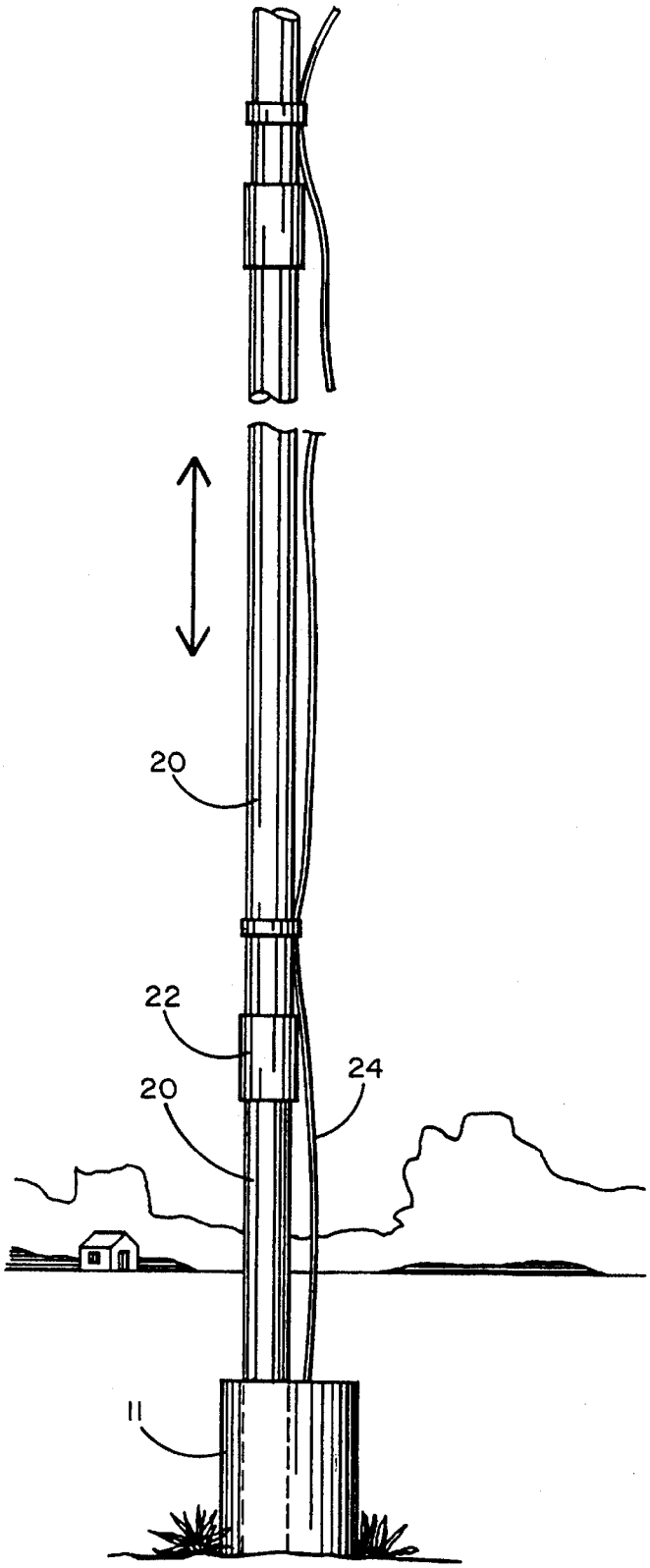
FIG. 2 illustrates a typical plurality of pipe sections and attendant electrical cable normally encountered in pulling a pump and attendant pipe and electrical cable from a deep well.

Referring to FIG. 2, it will be seen that a typical deep well installation comprises a pipe 20 having a plurality of pipe sections interconnected at respective threaded ends 22. It will also be seen that there is an electrical cable 24 which is tied to the pipe sections at intermediate spaced points, such as by tape or the like so that when the pipe and attendant pump (not shown) are pulled from the well casing 11, the electrical cable that provides electrical energy to run the pump motor accompanies the pipe as it is being pulled from the well casing. It will be understood that as the sections of pipe are pulled from the well casing 11 in order to gain access to the pump to which the pipe is connected, each section of pipe must be unthreaded from the next and each portion of cable connected to such section of pipe, must be disconnected by unwrapping or cutting the tape which secures the cable 24 to the pipe 20.

Figure 3:
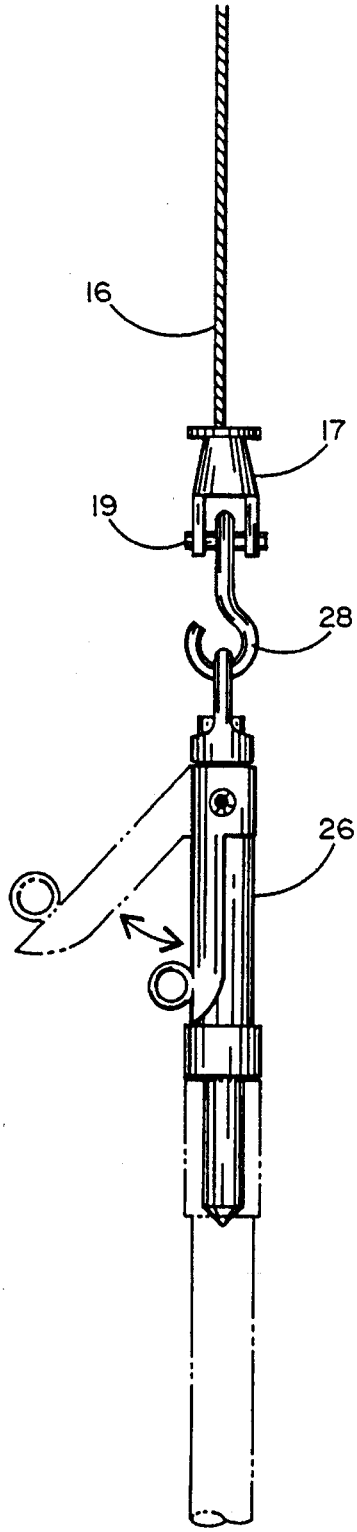
FIG. 3 illustrates the manner in which the pulling unit of the present invention interfaces with a section of pipe.
Figure 4:
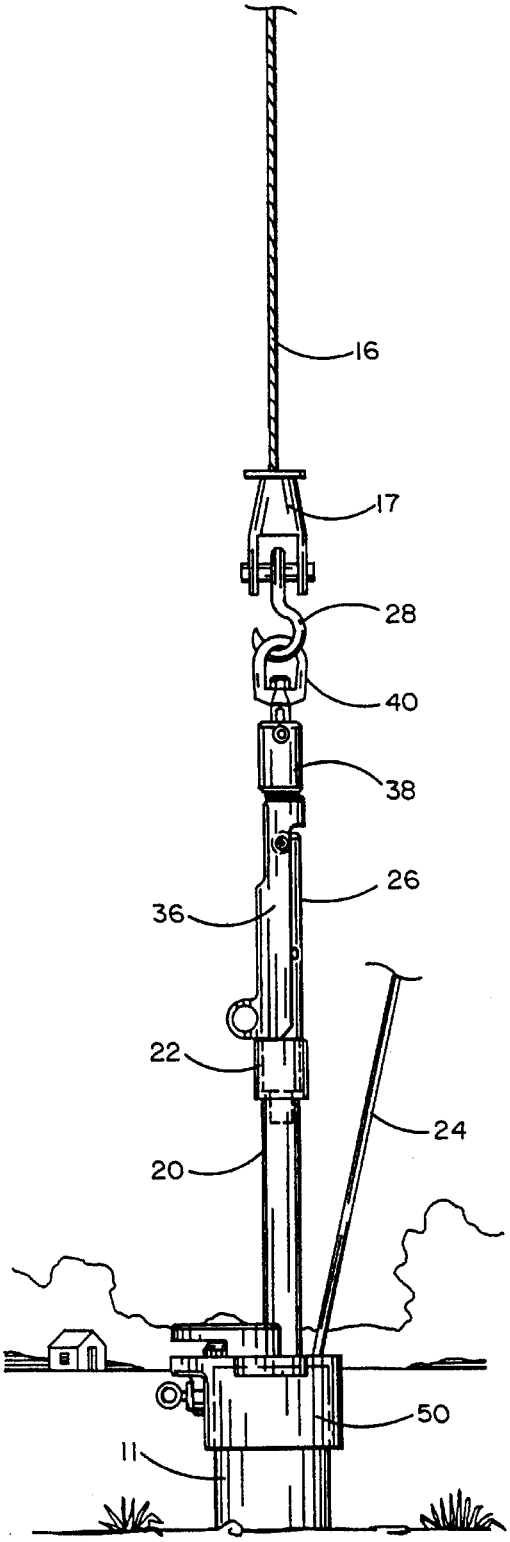
FIG. 4 illustrates the manner in which the pulling unit and holding plate of the present invention may be used in the illustrated embodiment to pull a pipe and attendant pump from a deep well.
Figure 5:
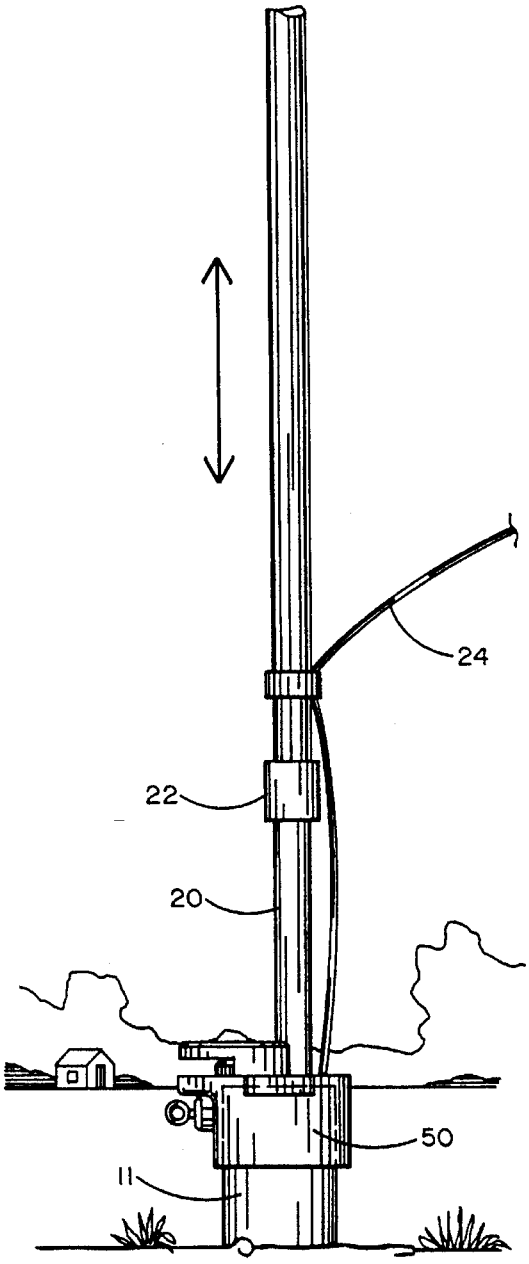
FIG. 5 illustrates the configuration of FIG. 4 but after the pulling system and hydraulic lift have extended the pipe one full pipe section above the well casing.

Referring to FIG. 3, it will be seen that the pulling cable 16 of the hydraulic-equipped vehicle 12 is connected to the open end of the upper most pipe section 20 by means of a pulling unit 26 which is connected to the cable 16 through a rotatable yoke 17, a yoke pin 19 and a hook 28. As shown in FIGS. 3 and 4, the pulling unit 26 is installed into the open end of the threaded portion of the pipe section at the top of the stack of pipe sections to which the pump is attached at the bottom of the well casing. Thus, by employing the hydraulic controls 14 of the vehicle 12, it is possible to pull the entire series of pipe sections and the underlying pump and pump motor up through the well casing towards the surface. FIG. 4 shows the cable 16 in its lower most position adapted to provide the requisite position for pulling unit 26 to be installed into the open end of the pipe 20. FIG. 5 shows the same combination of pulling unit and pipe, but with the cable 16 in its elevated position, having pulled the pipe out of the well casing 11 to a sufficient height to reach the next threaded portion 22 of the next pipe section which is then positioned immediately above the well casing 11 to facilitate unthreading the next section of pipe. It will be noted in FIGS. 4 and 5 that a holding plate 50 is positioned on the well casing 11 to facilitate the withdrawal of the pipe and pump in a manner to be described hereinafter in more detail.

Figure 6:
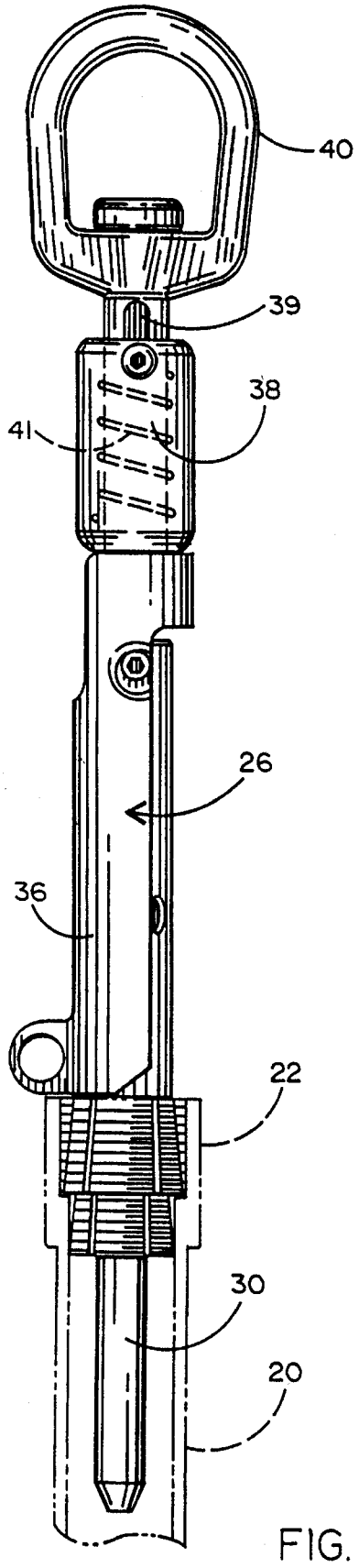
FIG. 6 is a more detailed view of the pulling unit of the present invention shown installed in a pipe section in its secured position.
Figure 7:
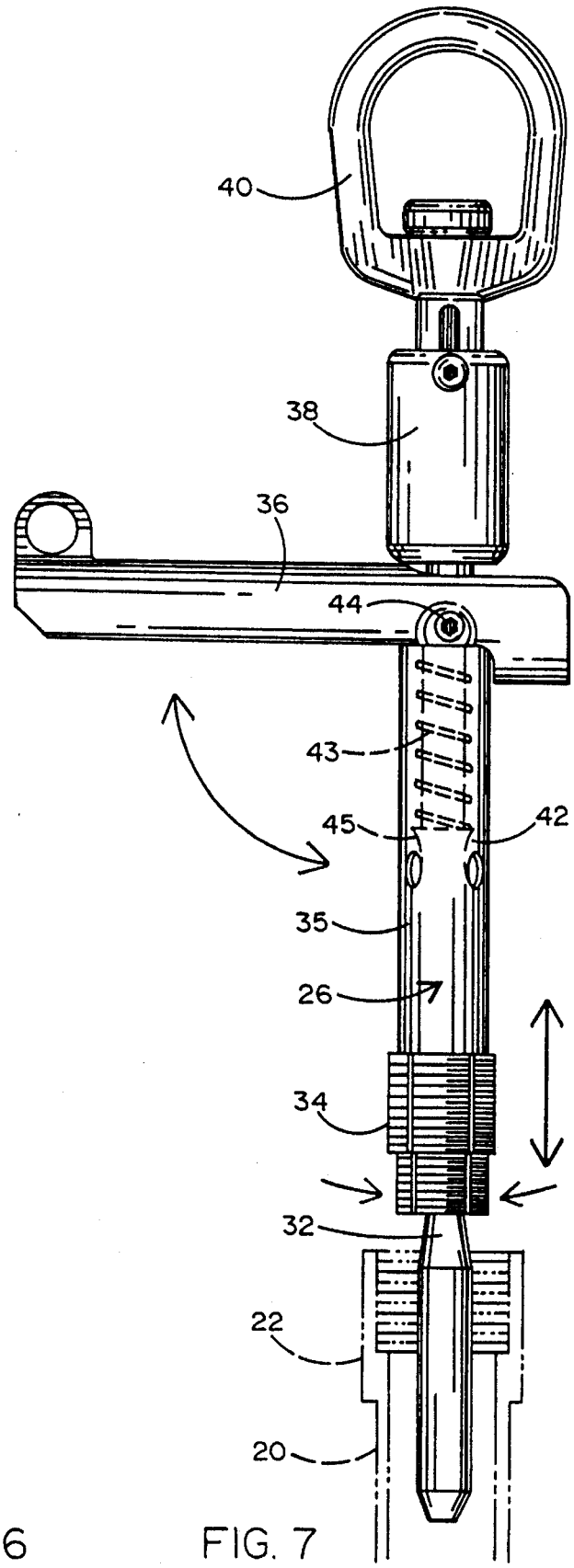
FIG. 7 is a view similar to that of FIG. 6, but showing the pulling unit in its unlocked position for releasing the pipe section therefrom.
Figure 8:
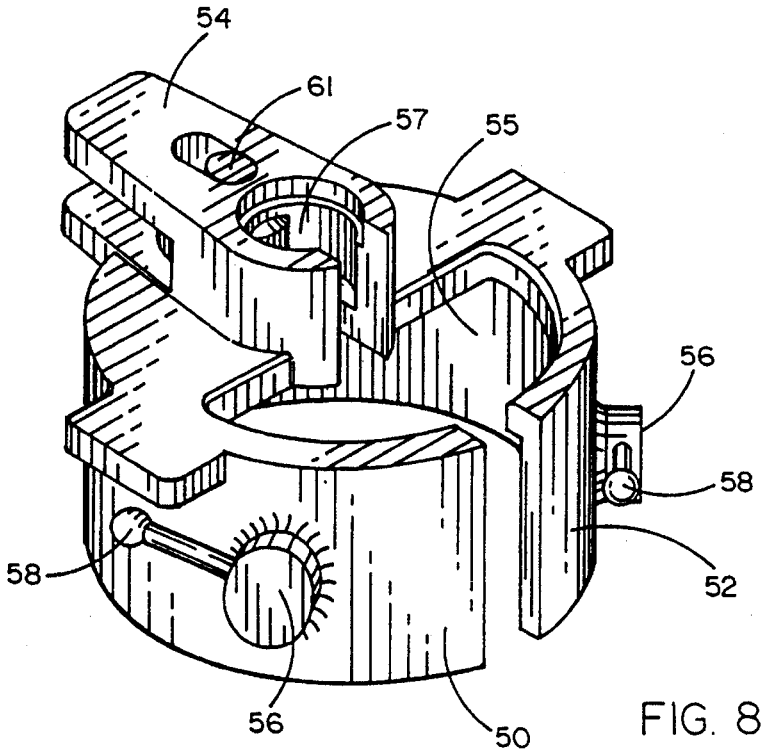
FIG. 8 is a three-dimensional view of the holding plate of the present invention.
Figure 9:
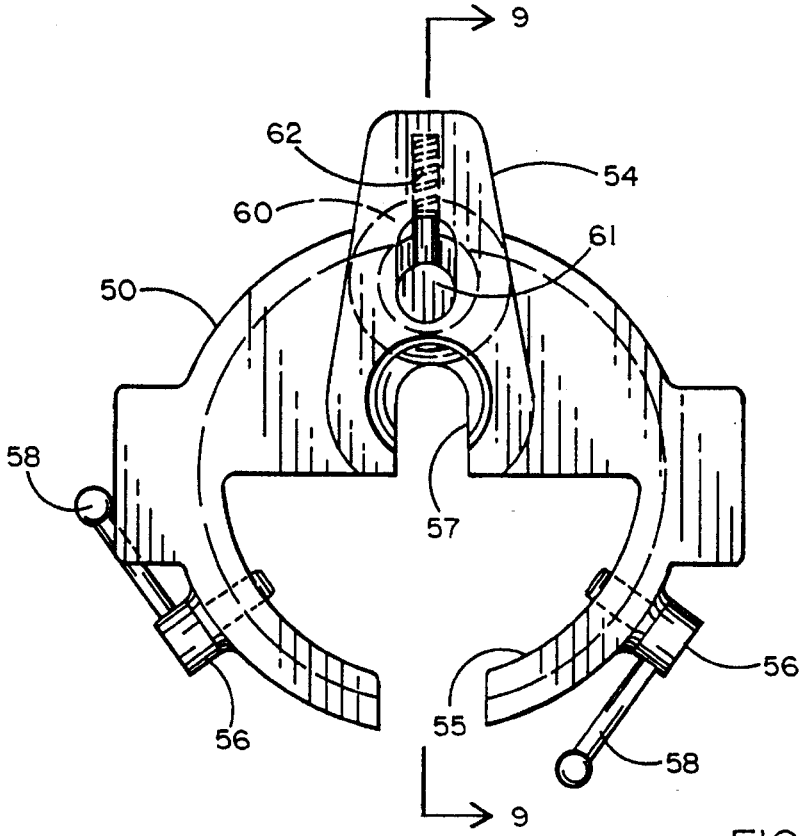
FIG. 9 is a top view of the holding plate of the present invention.

Reference will now be made to FIGS. 6 and 7 which provide a more detailed view of the pulling unit 26 of the present invention. More specifically, FIG. 6 illustrates the pulling unit 26 in its locked position, installed in a pipe section 20 and specifically in the threaded end 22 thereof. FIG. 7 illustrates the pulling unit 26 in its released or unlocked position wherein the pulling unit 26 may be removed from the pipe 20 to permit that section of pipe to be removed by unthreading it relative to the next section before continuing the sequence of steps for pulling the pipe and pump out of the well casing. As seen in FIGS. 6 and 7, the pulling unit comprises a tapered shaft 32 which is surrounded by a hollow cylinder 42, the end of which is provided with a threaded adaptor 34 and the mid-portion of which is provided with a plurality of expansion slots 35. A locking handle 36 is affixed to the hollow cylinder 42 by a pair of fasteners 44 for rotation about an axis through the fasteners. Immediately above the locking handle 36, there is provided a spring retainer 38 within which there is a locking spring 41 and above which there are an adjusting nut 39 and a lifting eye 40. It will be understood that the locking handle 36 cooperates with the spring retainer 38 to operate in a camming motion when it is in its locked position shown in FIG. 6 to extend the threaded adaptor 34 over and past the tapered shaft 32 to the a load shaft 30 shown at the lower most portion of FIG. 6. In this locked configuration and because of the relative dimensions of the cylinder 42 and the underlying tapered shaft 32, the threaded adaptor is expanded into a frustum of a cone or pair of conical shapes which are designed to frictionally engage the interior surface of the threaded end 22 of the pipe section 20 in the manner shown in FIG. 6. This frictional engagement is sufficient to secure the pipe section 20 and all the interconnecting pipes below that section to the pulling unit so that the entire assembly of pipes, pump and motor may be pulled through the well casing by operation of the hydraulic controls 14 on the hydraulic-equipped vehicle 12.

It will be seen in FIG. 7 that when the locking handle 36 is rotated into a position that is substantially perpendicular to the cylinder 42, the threaded adaptor 34 is released from the tapered shaft 32, allowing the adaptor to resume its normal cylindrical shape, thus disengaging the adaptor from the interior surface of the threaded end 22 of the pipe section 20 and allowing release of the pulling unit from the pipe section. An unlocking spring 43 and a shoulder 45 cooperate to permit disengagement.

Figure 12:
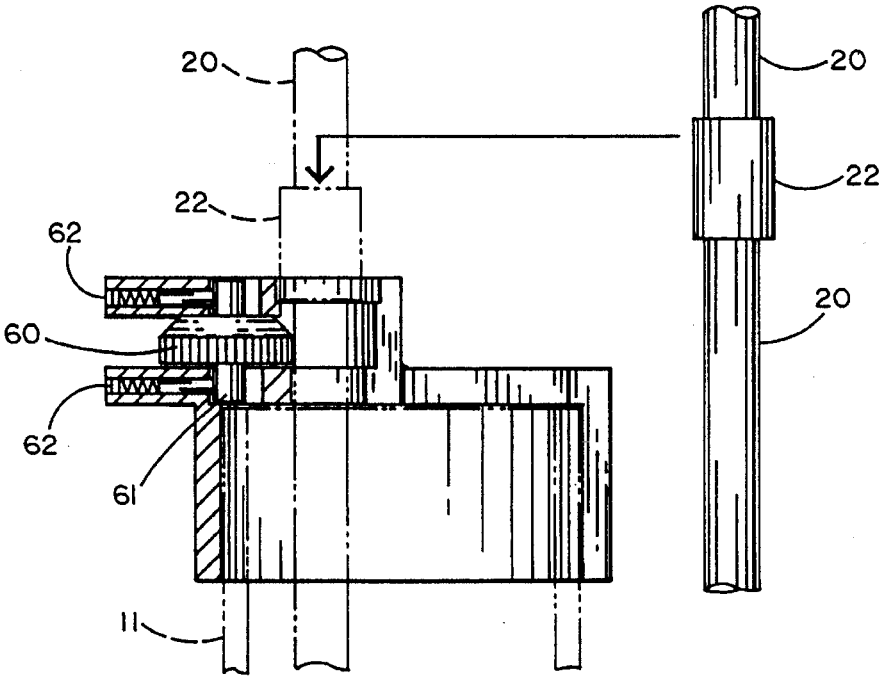
FIG. 12 is a side view of the holding plate of the present invention shown installed on the casing with a pipe section therein in its secured position and illustrating partially in cross section the details of the locking mechanism.

As previously indicated, the process of securing the series of interconnected pipes that are being pulled from the well casing while the upper most pipe section is unthreaded from the remaining pipe sections, is simplified and facilitated by a holding plate 50 which may be understood best by referring to FIGS. 8 through 12. As seen in those figures, holding plate 50 comprises a bottom section 52 and an upper section 54. The bottom section provides a large chamber 55, while the upper section 54 provides a small chamber 57. Positioned adjacent the small chamber 57 is a cam wheel 60 which rides on a central pin 61 positioned for movement against a pair of springs 62. It will also be seen that the holding plate 50 provides a plurality of locking bolts 56 controlled by a like plurality of locking handles 58. Bolts 56 and handles 58 provide a means for readily connecting the holding plate to the upper exterior surface of the underlying well casing 11 as shown in FIG. 12. As also shown in FIG. 12, the small chamber 57 operating in conjunction with the cam wheel 60 and spring 62, is designed to receive the pipe section 20 in a manner which secures the pipe section within the holding plate to permit the entire series of pipe sections pump and motor to be supported thereby while an upper section is threadably disengaged from the remaining sections. On the other hand, the large chamber 55 is designed to surround the pipe sections 20 while the pulling unit 26 is activated to pull the entire series of pipes up through the well casing without interfering or frictionally engaging the pipe sections so that the entire series of pipes and the underlying pump and motor are freely lifted out of the well casing in the manner shown in FIGS. 4 and 5.

Figure 13:
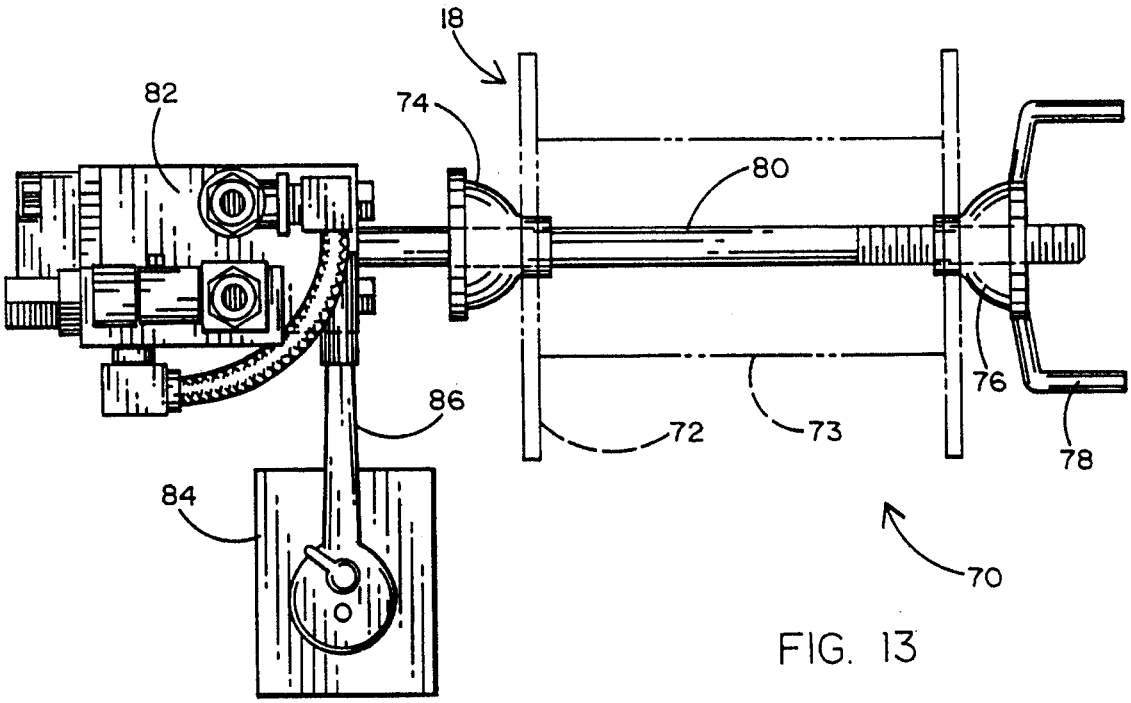
FIG. 13 is a plan view of the spool and attendant hydraulic motor and mounting bracket of the present invention.
Figure 14:
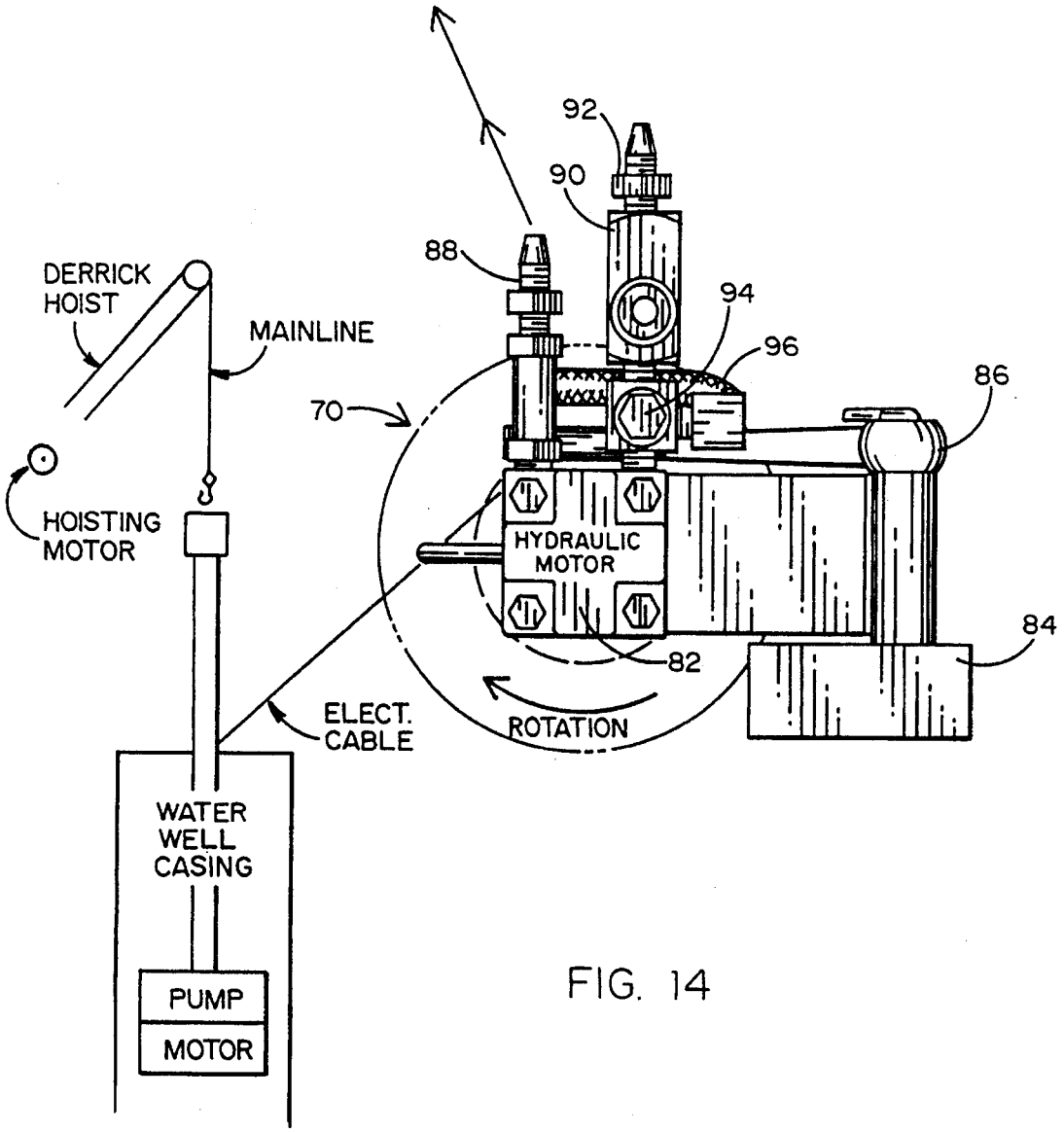
FIG. 14 is an end view of the spool hydraulic motor and mounting bracket of the invention.

A third advantageous feature of the present invention, namely the wire reel 18, is illustrated in FIGS. 13 and 14 to which reference will now be made. As seen in those figures, wire reel 18 comprises a hub assembly 70 which includes a spool 72 having a hub 73 and through which there is positioned a spool shaft 80. The spool shaft is connected at one end to a threaded spool cone 76 to which there is connected a cone handle 78 for facilitating the threading and unthreading of the cone onto a threaded end portion of the spool shaft 80, seen best in FIG. 13. The other end of the spool is connected to a fixed spool cone 74 which is fixedly connected to the spool shaft 80 so that tightening of the threaded spool cone 76 causes the hub 73 to rotate with the rotating spool shaft 80. Spool shaft 80 rotates as a result of connection to a hydraulic motor 82, which is in turn connected to a mounting bracket 84, having a ratchet adjustment control 86. Hydraulic motor 82 operates in response to the application of high pressure hydraulic fluid which circulates through the hydraulic motor through a pair of ports, namely fluid supply port 92 and fluid return port 88. Fluid control is facilitated by valves, including flow control valve 90 and pressure release valve 94. A motor bypass line 96 provides for direct flow between the supply port and the return port in the event it is necessary to either bypass the motor or compensate for excess pressure thereto.

By using a hydraulic motor to control the hub assembly 70 of the wire reel 18, the operation of the wire reel to collect the electrical cable attached to the pipe 20 as the pipe is lifted out of the well casing may be synchronized with the operation of the pulling unit 26 through the hydraulic controls 14 of the vehicle 12. The pressure release valve 94 is designed to automatically adjust fluid flow through the motor or bypass line for winding, stopping or unwinding operation and for tension on the wire or cable 24, regardless of the speed of the hoisting hydraulic motor in the vehicle 12. The adjustable mounting bracket 84 made adjustable by the ratchet control 86, provides for alignment of the spool to the well casing so that the cable 24 may be fed into the hub 73 in a direction which is substantially perpendicular to the spool shaft 80.

It will now be understood that what has been disclosed herein comprises a novel improved pump pulling system for pulling a pump from a deep well casing and including all the pipe normally attached to the pump. Pulling of the pump is normally required for maintenance purposes or for replacement of the pump. Normally such pumps are electrical and therefore an attendant electrical cable is also pulled with the pump when it is necessary to remove the pump from the well casing. The present invention facilitates and simplifies such pump pulling operations by providing three significant features comprising: A novel pulling unit which is designed to attach to the interior surface of the threaded end of each pipe section as it is disconnected from the next; a holding plate which is designed to overly the casing and facilitate securing the sections of pipe while each top section is threadably disconnected from the remaining sections; and a wire reel which is designed to operate in synchronism with the hydraulic lift mechanism to automatically spool on the electrical cable as it is released from the pipe sections to which it is normally attached in a typical pump installation. Thus, it will be seen that the present invention meets all of the aforementioned objects previously stated and provides a significant number of advantage over the prior art.

Those having skill in the art to which the present invention pertains, will now as a result of the applicant's teaching herein, perceive various modifications and additions which may be made to the invention. By way of example, the specific shapes of components disclosed herein, as well as the specific means for interconnecting such components for achieving the improvements disclosed herein, may be readily modified without deviating from the underlying inventive features disclosed herein. Accordingly, all such modifications and additions are deemed to be within the scope of the invention which is to be limited only by the claims appended hereto and their equivalents.

I claim:

1. A pump pulling system for extracting an electric pump from a well casing including a plurality of pipe sections threadably connected in series to provide a continuous pipe connected to the pump; the pump pulling system being used with a hydraulic lift having a lift cable for selected attachment to the pipe sections being lifted through the well casing; the system comprising:

a pulling unit having means for selectively interconnecting said lift cable and an uppermost one of said pipe sections;

a head unit for attachment to said well casing and having means for selectively gripping said pipe sections to permit support of said pump and pipe sections while said uppermost pipe section is disengaged from remaining pipe sections; and a wire reel connected to a hydraulic motor synchronized to the motion of said hydraulic lift for automatically spooling electrical cable attached to said pump as said pump and pipe sections are withdrawn from said well casing.

2. The system recited in claim 1 wherein said hydraulic motor of said wire reel is connected to the same hydraulic fluid supply as said hydraulic lift.

3. The system recited in claim 1 wherein said means for interconnecting in said pulling unit comprises a cam-operated expansion adapter having a threaded end selectively expandable to engage the interior threaded end of each said pipe section.

4. The system recited in claim 1 wherein said gripping means of said head unit comprises a chamber having a diameter of said pipe sections and a spring-load cam wheel for forcefully engaging said pipe sections within said chamber.

5. A pump pulling system for extracting an electric pump from a well casing including a plurality of pipe sections threadably connected in series to provide a continuous pipe connected to the pump; the pump pulling system being used with a hydraulic lift having a lift cable for selected attachment to the pipe sections being lifted through the well casing; the system comprising:

a pulling unit having means for selectively interconnecting said lift cable and an uppermost one of said pipe sections; and a head unit for attachment to said well casing and having means for selectively gripping said pipe sections to permit support of said pump and pipe sections while said uppermost pipe section is disengaged from remaining pipe sections.

6. The system recited in claim 5 wherein said means for interconnecting in said pulling unit comprises a cam-operated expansion adapter having a threaded end selectively expandable to engage the interior threaded end of each said pipe section.

7. The system recited in claim 5 wherein said gripping means of said head unit comprises a chamber having a diameter of said pipe sections and a spring-load cam wheel for forcefully engaging said pipe sections within said chamber.

8. A pump pulling system for extracting an electric pump from a well casing including a plurality of pipe sections threadably connected in series to provide a continuous pipe connected to the pump; the pump pulling system being used with a hydraulic lift having a lift cable for selected attachment to the pipe sections being lifted through the well casing; the system comprising:

a head unit for attachment to said well casing and having means for selectively gripping said pipe sections to permit support of said pump and pipe sections while said uppermost pipe section is disengaged from remaining pipe sections; and a wire reel connected to a hydraulic motor synchronized to the motion of said hydraulic lift for automatically spooling electrical cable attached to said pump as said pump and pipe sections are withdrawn from said well casing.

9. The system recited in claim 8 wherein said hydraulic motor of said wire reel is connected to the same hydraulic fluid supply as said hydraulic lift.

10. The system recited in claim 8 wherein said gripping mean: of said head unit comprises a chamber having a diameter of said pipe sections and a spring-load cam wheel for forcefully engaging said pipe sections within said chamber.

11. A pump pulling system for extracting an electric pump from a well casing including a plurality of pipe sections threadably connected in series to provide a continuous pipe connected to the pump; the pump pulling system being used with a hydraulic lift having a lift cable for selected attachment to the pipe sections being lifted through the well casing; the system comprising:

a wire reel connected to a hydraulic motor synchronized to the motion of said hydraulic lift for automatically spooling electrical cable attached to said pump as said pump and pipe sections are withdrawn from said well casing.

12. The system recited in claim 11 wherein said hydraulic motor of said wire reel is connected to the same hydraulic fluid supply as said hydraulic lift.

* * * * *